US008678621B2

(12) United States Patent
Bizzotto et al.

(10) Patent No.: US 8,678,621 B2
(45) Date of Patent: Mar. 25, 2014

(54) MOUNTING ARRANGEMENT FOR LIGHTING DEVICES, CORRESPONDING LIGHTING DEVICES AND METHOD

(75) Inventors: Alessandro Bizzotto, Castelfranco Veneto (IT); Simone Capeleto, Padua (IT); Christian Hacker, Regensburg (DE); Alessandro Scordino, Dolo (IT)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 507 days.

(21) Appl. No.: 13/124,706

(22) PCT Filed: Oct. 15, 2009

(86) PCT No.: PCT/EP2009/063447
§ 371 (c)(1),
(2), (4) Date: Apr. 18, 2011

(87) PCT Pub. No.: WO2010/043662
PCT Pub. Date: Apr. 22, 2010

(65) Prior Publication Data

US 2011/0199773 A1 Aug. 18, 2011

(30) Foreign Application Priority Data

Oct. 16, 2008 (EP) ..... 08166837

(51) Int. Cl.
*F21V 3/00* (2006.01)

(52) U.S. Cl.
USPC ..... 362/311.02; 362/310; 362/311.01; 362/311.03; 362/311.04; 362/311.05; 362/374; 362/375

(58) Field of Classification Search
USPC ..... 362/310, 311.01–311.05, 374–375
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 7,488,097 | B2 * | 2/2009 | Reisenauer et al. | 362/373 |
| 2008/0123341 | A1 * | 5/2008 | Chiu | 362/294 |
| 2008/0175019 | A1 * | 7/2008 | Hacker et al. | 362/555 |
| 2009/0034283 | A1 * | 2/2009 | Albright et al. | 362/545 |

FOREIGN PATENT DOCUMENTS

| | | |
|---|---|---|
| DE | 86 06 427 | 4/1986 |
| EP | 1 710 495 | 10/2006 |
| EP | 1 950 491 | 7/2008 |

* cited by examiner

*Primary Examiner* — Sean Gramling
(74) *Attorney, Agent, or Firm* — Cozen O'Connor

(57) ABSTRACT

A mounting arrangement for a light source (L) having associated a Printed Circuit Board, wherein said mounting arrangement includes: a housing (H) with an exit opening for light from the source (L), a reflector (R) to reflect light from the source (L) towards the opening, an at least partly transparent cover (1) to close the opening of the housing (H). The cover (1) includes a set of retaining elements (12A) for retaining the cover (1) to the housing (H), and a set of holding elements (12B) for holding the associated Printed Circuit Board (D) within the housing (H). Such configuration is capable of exerting a pressure on the reflector (R) when the cover (1) is coupled to the housing (H), and wherein the reflector (R) in turn urges the light source (L) against the housing (H), providing thus thermal coupling between the light source (L) and the housing (H).

13 Claims, 2 Drawing Sheets

MOUNTING ARRANGEMENT FOR LIGHTING DEVICES, CORRESPONDING LIGHTING DEVICES AND METHOD

RELATED APPLICATIONS

This is a U.S. national stage of application No. PCT/EP2009/063447, filed on Oct. 15, 2009.

This application claims the priority of European application no. 08166837.8 filed Oct. 16, 2008, the entire content of which is hereby incorporated by reference.

FIELD OF THE INVENTION

This disclosure relates to mounting arrangements for lighting devices.

More specifically, this disclosure was devised with specific attention paid to its possible use in lighting devices comprising at least one LED (Light Emitting Diode) module.

BACKGROUND OF THE INVENTION

Lighting devices comprising LED modules are increasingly used for lighting applications, such as for home environments. Such lighting devices are usually produced by assembling a plurality of components having different functions, such as a high power LED module (i.e. the light source), a Printed Circuit Board (PCB) containing e.g. an electronic driver for the LED module, optics, housing, and heat-sink if required.

A good thermal coupling between the LED module and the housing or the heat-sink is one of the key requirements in order to achieve a good thermal behavior of the LED module. In fact, in usual LED modules efficiency decreases for increasing operating temperature, because the forward voltage may decrease with increasing junction temperature. Moreover, the lifetime of the LED modules may be longer for lower operating temperatures, because aging usually depends strongly on the junction temperature.

A good mechanical contact between the LED module and the housing or the heat-sink is beneficial in order to achieve a good thermal coupling.

In some prior-art arrangements such thermal contact between the LED module and the housing or heat-sink is achieved by assembling the components with screws. Such screws fix and urge the PCB of the light source against the housing or heat-sink in order to ensure thermal contact. However, such arrangements may provide additional costs, because additional mechanical components (e.g. screws or washers) may be required, and a complex manual or automatic assembling process with its associated assembling time may be necessary.

OBJECT AND SUMMARY OF THE INVENTION

One object of the invention is to provide a mounting arrangement for lighting devices, which may be produced and assembled with lower costs compared to prior art solutions.

This and other objects are attained in accordance with one aspect of the present invention directed to a mounting arrangement for a light source having associated a Printed Circuit Board, wherein said mounting arrangement comprises a housing with an exit opening for light from said source; a reflector to reflect light from said source towards said opening; an at least partly transparent cover to close said opening of said housing; wherein said cover includes a set of retaining elements for retaining said cover to said housing; and a set of holding elements for holding said associated Printed Circuit Board within said housing.

Another aspect of the present invention is directed to a method of providing a mounting arrangement for a light source having associated a Printed Circuit Board, wherein the method comprises the steps of providing a housing with an exit opening for light from said source; locating with said housing a reflector to reflect light from said source towards said opening, applying an at least partly transparent cover to close said opening of said housing; and providing said cover with a set of retaining elements for retaining said cover to said housing and a set of holding elements for holding said associated Printed Circuit Board within said housing.

In an embodiment, the arrangement as described herein is an mounting arrangement for lighting device, which uses a minimum number of components, wherein some of the components may have multiple functions.

In an embodiment, a mounting arrangement is provided which, while not requiring any screws, still provides a stable mounting structure integrating optical and mechanical subsystems, and can be assembled with an easy and fast assembling process.

In an embodiment, the mounting arrangement comprises a housing, a reflector, and a cover. These components can be used in connection with a light source, such as a LED module, and a driver PCB, which contains an electronic driver for the light source, to assemble a lighting device.

In an embodiment, the cover comprises two snap-in systems. The primary snap-in system ensures the mechanical and thermal coupling with the housing via a simple pressure insertion, avoiding any screws, and the secondary snap-in system holds the driver PCB.

In an embodiment, both the housing and the light source have no direct mechanical contact to the driver PCB.

In an embodiment, the light source is mounted on a PCB. In this case, the cover may perform a vertical pressure on the reflector, which in turn may push the PCB of the light source against the housing, providing thus the necessary thermal coupling without the need of any screws.

In an embodiment, the cover is made of a single piece of plastic and contains also optics, such as a lens. The choice of separate optics or a single unique cover may depend on the product requirements. For example, a separate lens might be more suitable if different optic versions or high quality optics have to be supported.

In an embodiment, a separate lens is provided, wherein the cover and the lens may be coupled.

In this way, no additional mechanical components are required for the connections between the components and the assembling process may be simplified and automated, thus reducing production time and costs.

BRIEF DESCRIPTION OF THE DRAWINGS

An embodiment of the invention will now be described, by way of example only, with reference to the annexed representations, including four figures, numbered 1 to 4, which schematically show the components of the mounting arrangement described herein.

DETAILED DESCRIPTION OF THE DRAWINGS

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

The figures herein illustrate a mounting arrangement for a lighting source such as a LED lighting source L. The exemplary mounting arrangement illustrated herein comprises a housing H, a reflector R, and a cover 1.

In the embodiment shown, the housing H has a "distal" opening for emitting the light generated by the source L. The reflector R reflects light emitted by the light source L into the direction of the opening of the housing. The cover 1 is used to close the opening of the housing H, e.g. in order to protect the device or to fix an optic component, such as a lens, in the opening.

In the embodiment shown, the cover 1 comprises an optical component 14, such as a lens, and a support structure 10 for supporting the optical component 14 and retaining it in the opening of the housing.

In an embodiment, the cover is made of a single piece of plastic comprising both the optical component 14 and the support structure 10, which may result in lower production and assembly costs.

In an embodiment, the cover may include separate components, e.g. if different lenses are supported or if glass lenses are used.

The mounting arrangement illustrated herein can be used in connection with a light source and a driver PCB to produce a complete lighting device. No specific limitations are imposed on these components: for example, the light source may be a LED module mounted on an additional PCB, and no limitations exist as to the possible distribution of the electronic components between these circuits.

Figure 1:
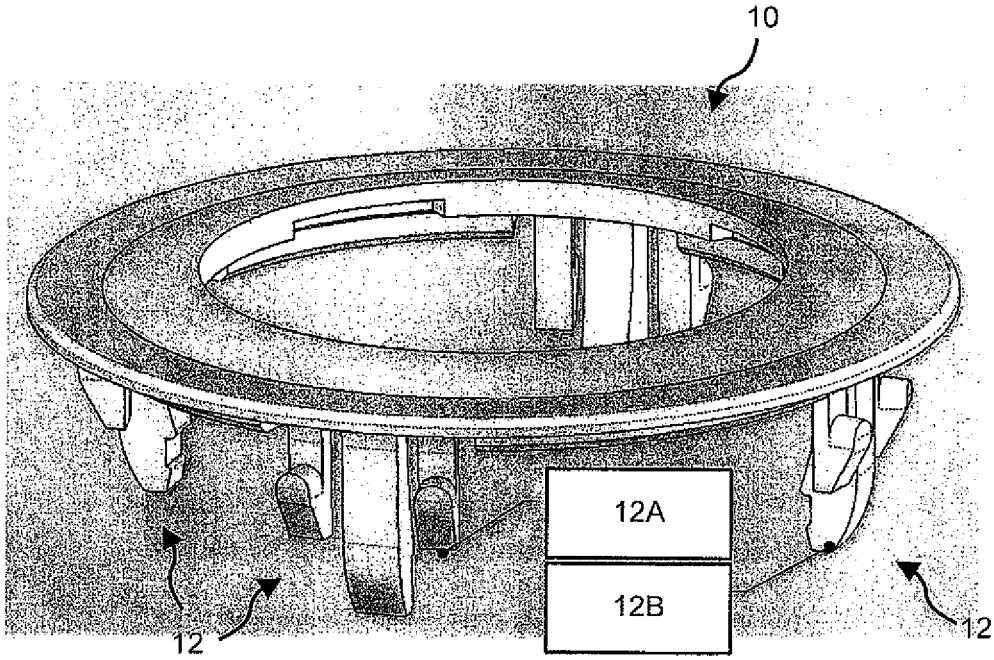

In the embodiment illustrated in FIG. 1, the support structure 10 comprises a plurality of snap-in elements 12.

In an embodiment, the structure 10 comprises a first set of snap-in tongue elements 12A to retain the cover 10 against the housing H. The structure 10 also comprises a second set of snap-in formations 12B to hold a PCB, such as a driver PCB D, in a fixed vertical and axial position.

For example, the PCB may have a form ensuring that the PCB has no direct contact with the housing H, when the circuit D is supported by the snap-in tongue elements 12B. In this way, the PCB is thermally insulated from the housing (i.e. the heat-sink) that usually operates at high temperatures. The circuit may thus operate at lower temperature with improved reliability. Moreover, the PCB is also electrically insulated from the housing thus improving also the safety of the device.

In an embodiment, the snap-in elements 12A and 12B act as flexural springs and absorb possible production tolerances of the other parts of the mounting arrangement or the PCB circuits.

In an embodiment, the snap-in elements 12A and 12B are arranged in sets (to the number of four in the embodiment shown) angularly distributed—e.g. uniformly, at 90° from each other. Each set includes a relatively longer snap-in element 12B interposed between a pair of relatively shorter snap-in element 12A.

The distal end of the snap-in element 12B has a groove (or a similar retain formation for the driver PCB D) opening "inwardly" of the generally ring-shaped structure 10.

The distal end of each snap-in element 12A carries a hook-like formation pointing "outwardly" of the structure 10.

The elements 12A and 12B operate as flexural springs and absorb possible production tolerances of the other parts of the mounting arrangement or the PCB circuits.

Figure 2:
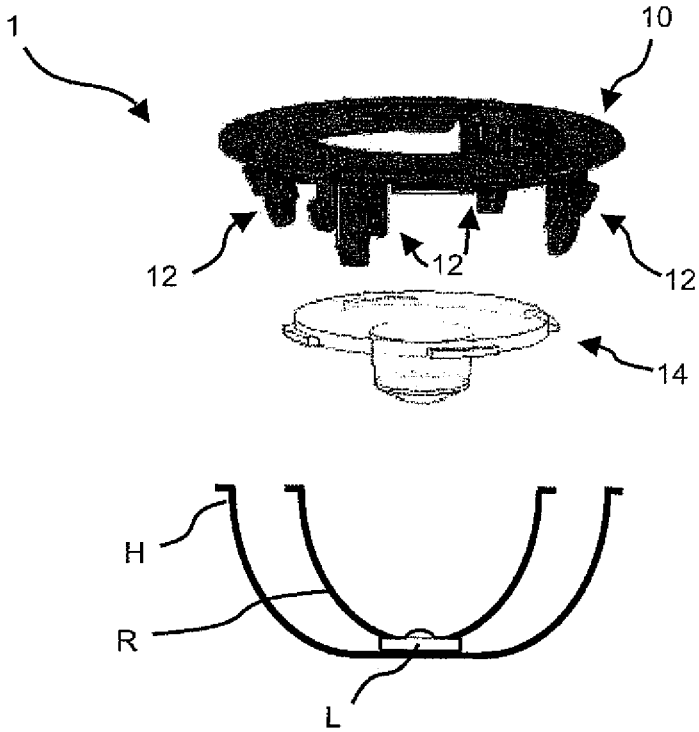

FIG. 2 shows a possible embodiment of a two-piece cover 1 including the support structure 10 described in the foregoing and an optical component 14, such as a lens.

In the exemplary embodiment, the support structure 10 and the optical component 14 exhibit complementary formations (e.g. cavities and/or protrusions) for coupling therebetween.

Figure 3:
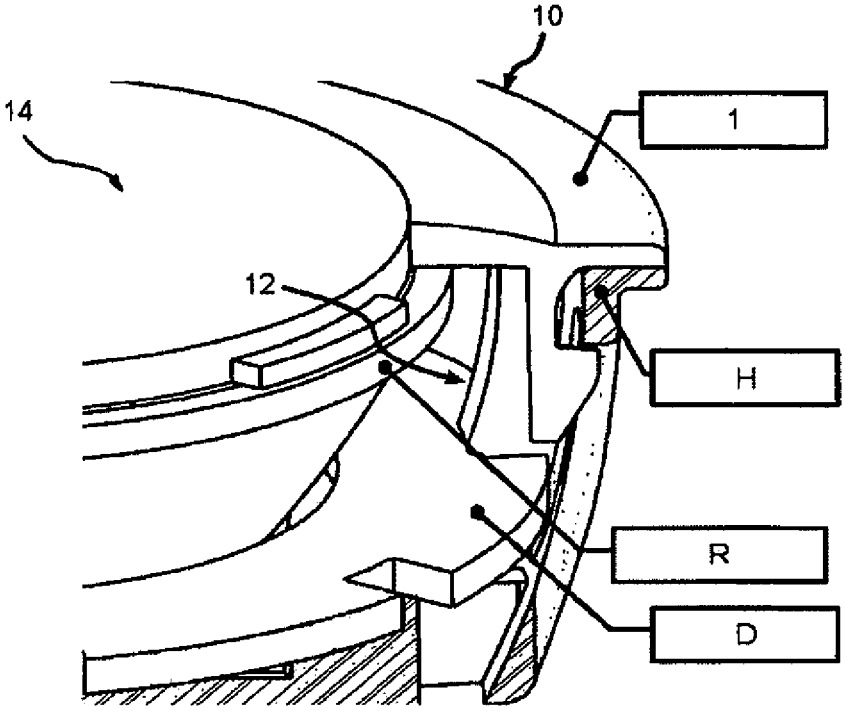

FIG. 3 shows a 3D view of the assembled system, wherein a driver circuit D is mounted inside the lighting device by inserting the driver circuit D into the snap-in elements 12B.

The light source L can be e.g. a LED module mounted on an additional PCB at the bottom of the reflector R.

In an embodiment, the structure 10 exerts a vertical ("downward" with reference to the viewpoint of the figures) pressure on the reflector R, with in turn urges the light source (e.g. the PCB of the LED module) against the housing H, thus providing thermal coupling without the need of any screws.

In an embodiment, the housing comprises a heat-sink in the vicinity of the light source in order to improve heat transfer from the light source L. Moreover, thermal paste or e.g. a PCB with metal core may be used to improve the thermal coupling and heat dissipation.

The following description is exemplary of a desing approach which provides a good thermal coupling between the light source and the heat sink.

Experiments show that the following simple model applies to the thermal contact between the light source and the heat-sink:

$$R_{th}=R_{th\infty}+kF^{-2}$$

where $R_{th}$ is the thermal resistance in ° K, F is the applied force in Newton, and $R_{th\infty}$ and k are two constants. For example, in a typical application $R_{th\infty}$ may be 0.2° K, and k may be 60° K/N.

In an embodiment, the force F is created by means of the snap-in elements 12A when the cover 1 is fixed to the housing H. For example, the "optimum" force $F_{opt}$ may be chosen according to application requirements based on a trade-off between mechanical complexity, material characteristics and thermal coupling requirements.

The mechanical design should ensure sufficient pressure for all operating conditions, including also worst case conditions, such as the highest admitted operating temperature.

Accordingly, applying a predetermined optimal force $F_{opt}$ the "optimum" thermal resistance is reached:

$$R_{th}=R_{th\infty}(l+\delta)$$

where δ represents the relative deviation from the minimum resistance achievable, and has to be determined for the specific application.

How such a force can be produced by a snap-in element such as the snap-in elements 12A considered will now be described with reference to the exemplary snap-in system shown in FIG. 4.

In this exemplary case, the upper surface of the snap-in elements 12A is angled and generates thus a vertical force F. Accordingly, the displacement of the snap 12A with respect to the snap-in system coupling point (point C in FIG. 4) has to be estimated in order to design a flexure which generates the required axial force $F_y$.

The required axial force of the single snap-in system can be calculated as:

$$F_y=F_{TOT}/n$$

where $F_{TOT}$ is the total required force, which is necessary to provide good thermal coupling, and n is the number of snaps.

Figure 4:
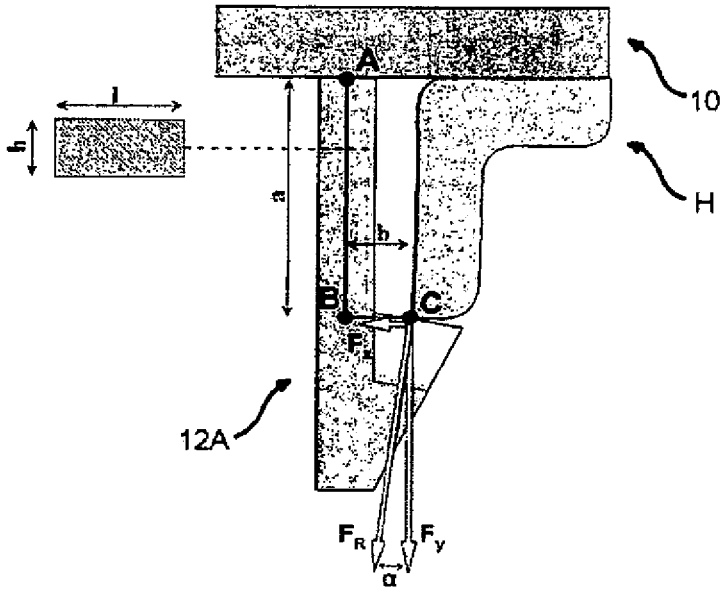

Moreover, the bending moment $M_f(y)$ may be calculated according to the relationship:

$$M_f(y)=F_y\cdot b+F_x\cdot a-F_x\cdot y$$

where a is the nominal distance between the cover and the snap-in system coupling point (e.g. the distance between points A and B in FIG. 4), b is the nominal distance of the snap from the snap-in system coupling point (e.g. the distance between points B and C in FIG. 4), and y is the vertical distance from the cover (e.g. the vertical distance from point A in FIG. 4).

The bending moment reaches its maximum for y=0, i.e.:

$$\begin{aligned} M_{fMax} &= M_f(y=0) = F_y\cdot b + F_x\cdot a = \\ &= F_y\cdot b + F_y\cdot a\cdot\tan(\alpha) = \\ &= F_y\cdot[b + a\cdot\tan(\alpha)] = \\ &= (F_{TOT}/n)\cdot[b + a\cdot\tan(\alpha)] \end{aligned}$$

where $\alpha$ is the inclination of the surface of the snap 12A.

In an embodiment, the maximum bending moment $M_{fMAX}$ is used to calculate the flexural stress according to:

$$\sigma_f(y)=(b/2)\cdot(M_f(y)/J_{xx})$$

where $J_{xx}$ is the second-order geometrical moment, which may be calculated according to:

$$J_{xx}=1/12\cdot l\cdot h^3$$

where l is the width of the snap and h is the thickness of the snap in horizontal direction.

The flexural stress reaches its maximum for y=0, i.e.:

$$\sigma_{fMax}=\sigma_f(y=0)=b/2\cdot F_{TOT}/(n\cdot J_{xx})\cdot[b+a\cdot\tan(\alpha)]$$

In an embodiment, also the tensile stress generated by the vertical component $F_y$ is considered:

$$\sigma_N=F_y/(h\cdot l)=F_{TOT}/(n\cdot h\cdot l)$$

Thus the maximum total stress (at the coordinate y=0) may be calculated as the combined stress:

$$\sigma_{TOT}=\sigma_{fMax}+\sigma_N$$

The total stress may then be compared with the admittable material characteristics to determine the required displacement $\mu(y)$, which is necessary to generate the required force:

$$\mu(y) = \frac{1}{E\cdot J_{xx}}\cdot\left[F_y\cdot b\cdot\frac{y^2}{2} + F_x\cdot a\cdot\frac{y^2}{2} - F_x\cdot\frac{y^3}{6}\right]$$

where E is Young's modulus.

For example, the displacement of point B in FIG. 4 (i.e. y=a) results in:

$$\begin{aligned} \mu_B &= \frac{1}{E\cdot J_{xx}}\cdot\left[F_y\cdot b\cdot\frac{a^2}{2} + F_x\cdot a\cdot\frac{a^2}{2} - F_x\cdot\frac{a^3}{6}\right] \\ &= \frac{1}{E\cdot J_{xx}}\cdot\left[F_y\cdot b\cdot\frac{a^2}{2} + F_x\cdot a\cdot\frac{a^2}{3}\right] \end{aligned}$$

The required displacement $\mu_B$ may then be used to design the profile of the snap-in system.

Without prejudice to the underlying principles of the invention, the details and embodiments may vary, even significantly, with respect to what has been described herein merely by way of example, without departing from the scope of the invention as defined by the annexed claim.

The invention claimed is:

1. A mounting arrangement for a light source, wherein said mounting arrangement comprises:

a housing with an exit opening for light from said light source;

a reflector to reflect light from said light source towards said opening; an associated printed circuit board containing an electronic driver for driving said light source;

an at least partly transparent cover to close said opening of said housing;

wherein said cover includes:

a set of retaining elements for retaining said cover to said housing; and a set of holding elements for holding said associated printed circuit board within said housing; wherein said light source is a light emitting diode (LED) module mounted on a second printed circuit board at the bottom of said reflector, and wherein said associated printed circuit board is mounted above said LED module in said set of holding elements and is thermally and electrically insulated from said housing.

2. The mounting arrangement of claim 1, wherein said cover includes an optical component and a support structure, and wherein said support structure carries said retaining elements and said holding elements.

3. The mounting arrangement of claim 2, wherein said support structure includes a ring-shaped structure.

4. The mounting arrangement of claim 3, wherein said retaining elements and said holding elements are arranged in groups angularly distributed on said ring-shaped support structure.

5. The mounting arrangement of claim 4, wherein each group of said retaining elements and said holding elements includes a relatively longer holding element interposed between a pair of relatively shorter retaining elements.

6. The mounting arrangement of claim 3, wherein each of said holding elements has a groove at the distal end opening inwardly of said ring-shaped support structure.

7. The mounting arrangement of claim 3, wherein each of said retaining elements has at the distal end a hook-like formation pointing outwardly of said ring-shaped support structure.

8. The mounting arrangement of claim 2, wherein said support structure and said optical component exhibit complementary formations for coupling therebetween.

9. The mounting arrangement of claim 1, wherein said cover is a single piece of plastic.

10. The mounting arrangement of claim 1, wherein said retaining elements and/or said holding elements are configured as flexural springs for absorbing possible production tolerances.

11. The lighting device of claim 1, wherein said cover is configured to exert a pressure on said reflector when said cover is coupled to said housing by means of said set of retaining elements, and wherein said reflector in turn urges said light source against said housing, providing thus thermal coupling between said light source and said housing.

12. The lighting device of claim 1, wherein said second printed circuit board has a metal core in order to improve thermal coupling.

13. A method of providing a mounting arrangement for a light source, wherein the method comprises the steps of:

providing a housing with an exit opening for light from said light source;

providing a reflector within said housing to reflect light from said light source towards said opening; providing an associated printed circuit board containing an electronic driver for driving said light source;

applying an at least partly transparent cover to close said opening of said housing; and providing said cover with:

a set of retaining elements for retaining said cover to said housing, and a set of holding elements for holding said associated printed circuit board within said housing; wherein said light source is a light emitting diode (LED) module mounted on a second printed circuit board at the bottom of said reflector, and wherein said associated printed circuit board is mounted above said LED module in said set of holding elements and is thermally and electrically insulated from said housing.

* * * * *